US005564779A

United States Patent [19]

Tolbert et al.

[11] Patent Number: 5,564,779

[45] Date of Patent: Oct. 15, 1996

[54] TABLE ATTACHMENT FOR CHAIRS

[76] Inventors: Arthur L. Tolbert, Rte. 6, Box 400, Gainesville, Tex. 76240; Wayman F. Standifer, Box 175, Krum, Tex. 76249

[21] Appl. No.: 168,604

[22] Filed: Dec. 16, 1993

[51] Int. Cl.[6] ..... A47B 39/00

[52] U.S. Cl. ..... 297/144; 297/463.1; 297/173

[58] Field of Search ..... 297/135, 144, 297/148–151, 154, 155, 160–162, 170, 171, 173, 174, 463.1; 108/50

[56] References Cited

U.S. PATENT DOCUMENTS

| | | | |
|---|---|---|---|
| 818,917 | 4/1906 | Ruger | 297/173 |
| 3,197,253 | 7/1965 | Brown . | |
| 3,266,840 | 8/1966 | D'Estrubé | 297/170 X |
| 3,267,887 | 8/1966 | Boyd . | |
| 3,894,496 | 7/1975 | Phillips et al. . | |
| 4,003,598 | 1/1977 | Glaze . | |
| 4,591,206 | 5/1986 | Pribble . | |
| 5,035,464 | 7/1991 | Spallholtz | 297/144 |
| 5,038,451 | 8/1991 | Smith . | |
| 5,129,702 | 7/1992 | Ervin | 297/144 |

FOREIGN PATENT DOCUMENTS

| | | | |
|---|---|---|---|
| 119841 | 4/1945 | Australia | 297/154 |
| 664777 | 9/1929 | France | 297/144 |
| 363197 | 11/1922 | Germany | 297/144 |
| 3116915 | 11/1982 | Germany | 297/162 |
| 602396 | 5/1948 | United Kingdom | 297/144 |

*Primary Examiner*—Milton Nelson, Jr.
*Attorney, Agent, or Firm*—Baker & McKenzie

[57] ABSTRACT

A tabletop attachment for chairs is provided which is mounted onto a leg of a chair. The attachment includes an arm connected to the tabletop. The pivotal movement of the arm enables the tabletop to be stored under the seat of the chair when it is not in use. If mounted onto a collapsible chair, the tabletop can fold with the chair without affecting collapsibility or portability of the chair. Horizontal pivotal movement of the tabletop away from the chair enables a person sitting in the chair to get in and out of the chair without removing food or other items from the tabletop.

22 Claims, 2 Drawing Sheets

TABLE ATTACHMENT FOR CHAIRS

FIELD OF THE INVENTION

This invention relates generally to chairs and more specifically to lightweight foldable chairs commonly referred to as lawn chairs or beach chairs. The present invention provides an improved table attachment for a foldable lawn or bench chair. The table attachment of the present invention is capable of pivoting horizontally away from the user while seated, pivoting vertically downward and neatly folding underneath the seat of the chair.

BACKGROUND OF THE INVENTION

The concept of folding lawn and beach chairs is well known and further table-like attachments for these types of chairs are known. However, the table attachments for folding lawn and beach chairs suffer from three primary deficiencies.

First, the currently available table attachments that are positioned in front of the person sitting in the chair do not easily pivot away from the person to enable the person to get up out of the chair without removing the attachment from the chair. This is particularly inconvenient if a person desires to get up out of the chair in the middle of a meal without desiring to remove the table attachment from the chair. Accordingly, a table attachment that pivots away from the chair in a horizontal plane would be advantageous.

Second, other types of table attachments do not fold up neatly with the folding chair. They are separate attachments that must be mounted onto the folding chair each time the table attachment is used. It is often difficult or awkward to attach and remove the table from a lightweight folding chair. Thus, because the table attachments do not fold with the folding chair they severely limit the portability of the chair/table attachment combination.

Third, the table attachments currently available do not fold downward for storage underneath the seat when not in use. The attachments must either be removed or they hang down from a side of the chair which is both unsightly and poses the hazard of tripping someone walking past the chair.

Specific examples in the prior art illustrate these deficiencies.

U.S. Pat. No. 3,894,496 to Phillips discloses a table adapted for a folding lawn chair. However, the table must be mounted to the chair after the chair is unfolded and set up. Accordingly, the table must be removed from the chair and transported separately if the chair and table are to be moved.

U.S. Pat. No. 4,003,598 to Glaze discloses a tray mounted to a folding chair. The Glaze patent is an example of a tray that does not fold with the chair. The tray is pivotally mounted to one arm of the chair and would interfere with the backrest of the chair if the chair were to be folded. Thus, the Glaze tray must be transported separately from the chair and therefore severely limits the portability of the chair/table combination. The same problem is illustrated in U.S. Pat. No. 3,267,887 to Boyd. The tables disclosed in both Glaze and Brown are also disposed to the side of the chair and are useful to hold drinks and snacks but not a full meal.

U.S. Pat. No. 4,591,206 to Pribble discloses a table attachment for a folding chair that is mounted on both arms of the chair. While the table can pivot away from the person sitting in the chair to enable the person to leave during a meal, the table attachment must be disconnected from the two supports connecting the table to the arms of the chair in order to fold the chair. Thus, the table attachment of Pribble is not an integral part of the Pribble chair and makes a significant impact on the portability of the chair.

U.S. Pat. No. 5,038,451 to Smith discloses a tray mounted on both arms of a folding chair. The tray may be relatively easily removed and attached to the arms and can be used as a cafeteria tray. However, to fold the chair, the tray must be removed, the chair folded and then the tray reattached onto the arms of the chair to lock the chair in the folded position. This procedure is difficult and inconvenient especially in most picnic or beach settings.

U.S. Pat. No. 3,197,253 to Brown discloses a folding side table for a folding chair. The Brown table is not capable of pivoting away from the person sitting in the chair but instead pivots upward to one side to a vertical position before pivoting downward to the side of the chair. Accordingly, food must be removed from the table before a person can exit the chair. Further, the Brown table is incapable of folding underneath the seat to allow someone to sit in the chair with the table disposed underneath the seat. Instead, the Brown table hangs down at one side of the chair which is suitable for auditorium purposes but many consumers find this unsightly for use on a patio. In addition, people may trip on a table hanging on the side of a chair on a crowded patio or campsite.

Accordingly, it would be highly desirable to provide a table attachment for a chair including foldable lawn and beach chairs whereby the tabletop attachment may be permanently mounted to the chair and does not require dismounting or removal of the attachment in order to fold, store or transport the chair. Further, it would be desirable to provide such a table attachment that would be capable of pivoting away from the user while maintaining a horizontal configuration to enable the user to leave during the course of the meal without removing all of the food from the table attachment. Still further, it would be desirable for such an attachment to conveniently fold with the folding chair so as not to affect the portability of the chair. Finally, it would be preferable to provide such an attachment that is also capable of folding downward underneath the seat so that a user may sit in the chair with the table conveniently stored underneath the seat.

SUMMARY OF THE INVENTION

The present invention makes a significant contribution to the lawn and beach chair art by providing improved tabletop attachments for foldable lawn and beach chairs as well as unfoldable patio-style chairs. The present invention provides an improved table attachment that may be folded downward and stored neatly under the seat of a chair or folding chair so as to enable a person to sit in the chair without the table being in the way when it is not in use. Further, the table attachment may be pivoted away from the user to enable the user to get out of the chair without removing the attachment from the chair or removing food and drinks from the table attachment. Finally, the attachment folds neatly with the folding chair and does not affect the compactness or transportability of a folded chair.

The table attachment of the present invention includes a mounting means for fixedly connecting the table attachment to a front leg of the chair. Preferably, the mounting means is in the form of a plate. The plate may be attached to a chair with brackets or other suitable attachment means.

An arm is pivotally attached to the plate, preferably at an upper portion thereof. The means for pivotally attaching the arm to the plate can a bolt, pin, rod or other suitable pivotal attachment means. A frame that supports the table is pivotally attached to the arm at an opposing end thereof. The frame may be pivotally attached to the arm directly or a link attached to the opposing end of the arm may thereafter be pivotally connected to the frame. If a link is employed, the link may also be pivotally attached to the arm providing increased flexibility of the table attachment.

In the preferred embodiment, the table frame is pivotally attached to the link with a collar. The collar matably engages a bushing which in turn matably engages a shaft disposed at a distal end of the link. The bushing pivots about the shaft and the collar is fixed to the bushing thereby enabling the frame to pivot about the shaft. The bushing preferably includes a slot. The shaft preferably includes a dog or protuberance extending out from the shaft that is accommodated in the slot. The slot/dog combination restricts pivotal movement of the frame and table about the shaft. One end of the slot engages the dog when the table is pivoted away from the chair enabling the user to exit the chair with the table in the horizontal position. The other end of the slot engages the dog when the table is directly in front of the user or when the front edge of the table is parallel to the backrest of the chair.

When the chair is in the folded position, the table is disposed underneath or adjoining the underside of the seat. When the folded chair is opened, the table remains neatly underneath the seat and out of the way. To raise the table, the user grasps the table and lifts upward. The arm pivots upward in a generally vertical plane until the spring-biased pin which passes through the arm is aligned with an aperture disposed in the plate. The pin then passes through the arm and matably engages the aperture in the plate and locks the arm in the up position. At this point, the table will normally be in a horizontal position and ready for use. The table may be pivoted away from the chair because the table and frame may pivot about the link which is connected to the arm. When the table is no longer needed, the pin is pulled out of the aperture and gravity drops the arm into the down position. Concurrently, the table drops below the seat and conveniently out of the way. The chair is now ready to be folded and the table will remain neatly folded alongside the seat of the chair.

The table attachment may be provided with a conventional unfoldable chair, a lawn chair or a beach chair or the attachment may be provided as a retrofit kit for an existing chair. Accordingly, the present invention provides an improved method for retrofitting existing chairs with the table attachment. The plate is mounted to a front leg of a chair and the arm is pivotally mounted to the plate. The arm is equipped with the spring-biased pin for engaging an aperture disposed in the upper end of the plate when the arm is in the upright position. The link is attached to the upper end of the arm and the collar and bushing are mounted over the shaft disposed at the distal end of the link. A dog for engaging the slot disposed in the bushing is then installed in the distal end of the shaft which also secures the frame, collar and bushing in place on top of the link. The table may then be installed in the frame. Many suitable bracket and brace configurations will be apparent to those skilled in the art for mounting the plate to the leg of the chair.

Accordingly, it is an object of the present invention to provide an improved table attachment for a chair.

Yet another object of the present invention is to provide an improved table attachment for a chair which pivots away from the user in a horizontal plane enabling the user to exit the chair and further pivots downward to be stored underneath the seat of the chair when not in use.

Still another object of the present invention is to provide a folding table attachment for a folding chair which does not have to be removed in order to fold the chair.

Yet another object of the present invention is to provide a table attachment for a chair that may be stored underneath the seat of the chair when not in use.

BRIEF DESCRIPTION OF THE DRAWINGS

This invention is illustrated more or less diagrammatically in the accompanying drawings, wherein.

Figure 1:
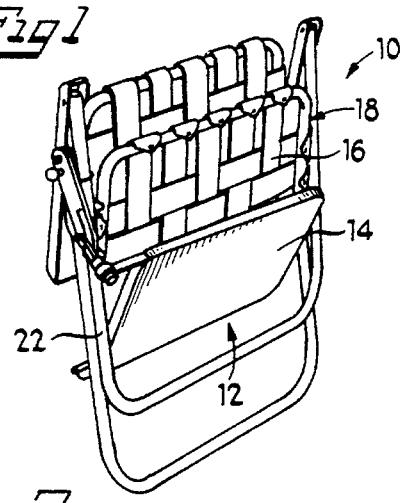
FIG. 1 is a perspective view of a folding lawn chair including the table attachment made in accordance with the present invention, the lawn chair and table attachment being in a folded position.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE INVENTION

Like reference numerals will be used to refer to like or similar parts from Figure to Figure in the following description of the drawings.

One important advantage of the present invention is illustrated in FIG. 1. Specifically, FIG. 1 illustrates a folding chair 10 equipped with the table attachment 12 of the present invention. When the chair 10 is in the folded position as shown in FIG. 1, the table 14 folds neatly underneath the underside 16 of the seat 18.

Figure 2:
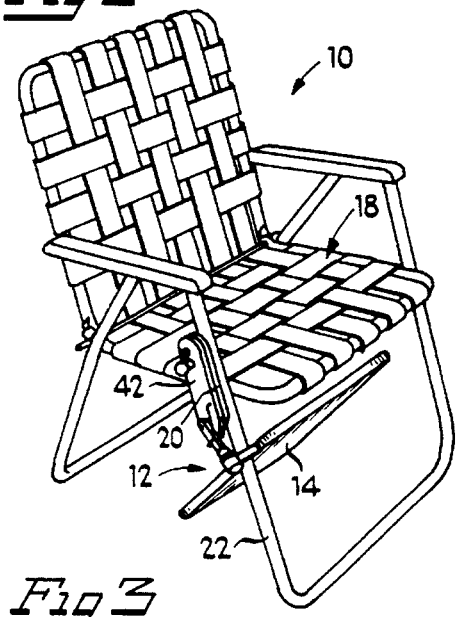
FIG. 2 is a perspective view of a folding lawn chair equipped with the table attachment shown in FIG. 1, the lawn chair being in the open position and the table attachment being in a down position.

Turning to FIG. 2, another important advantage of the present invention is illustrated. Specifically, when the chair 10 has been unfolded and is in the ready-to-use position illustrated in FIG. 2, the table 14 remains neatly disposed underneath the seat 18 and out of the way. Accordingly, if someone desires to sit in the chair 10, he/she may do so easily and the table 14 will not be in the way.

Figure 3:
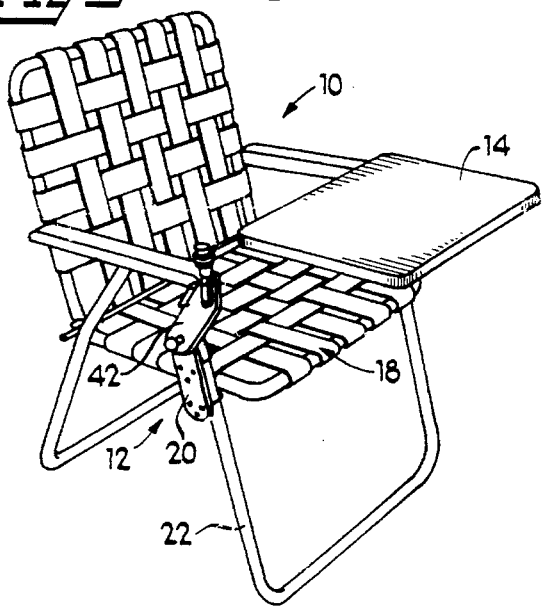
FIG. 3 is an illustration of the chair shown in FIG. 2 with the table attachment pivoted upward and disposed in an up position.

Turning to FIG. 3, the chair 10 and table attachment 12 are both in the ready-to-use position. The table 14 has been pulled upward and pivoted directly in front or the user. To go from the position shown in FIG. 2 to the position shown in FIG. 3, the table 14 is grasped, pivoted outward, pivoted upward and then pivoted back inward to assume the position shown in FIG. 3. This maneuverability is provided by the components illustrated in FIG. 4 and equivalents thereof.

Figure 4:
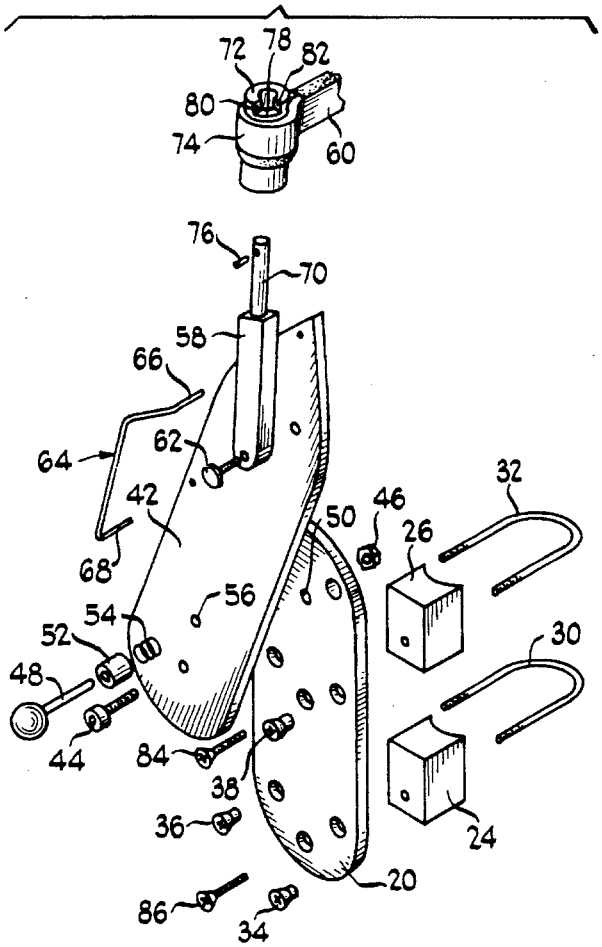
FIG. 4 is an exploded view of one mounting means for connecting the table attachment of the present invention to a chair.

Turning to FIG. 4, the basic components of one embodiment of the present invention are illustrated. The plate 20 is mounted to the leg 22 (see FIGS. 1–3) of the chair 10 with the spacer blocks 24, 26, U-shaped brackets 30, 32 and nuts 34, 36, 38, 40 (see also FIG. 7). The plate 20 may be attached to the leg 22 with a variety of means. The means shown in FIG. 4 is only one embodiment. Further, an additional spacer block may be employed and the number of spacer blocks 24, 26 required will depend on the thickness of the plate 20 and the materials used to fabricate the plate 20. One preferred material is aluminum due to its relatively high strength and light weight.

The arm 42 is pivotally attached to the plate 20 with the bolt 44 and nut 46. Of course, other means for pivotally attaching the arm 42 to the plate 20 will be readily apparent to those skilled in the art. Further, while the plate 20 and arm 42 are plate-like in configuration as shown in FIG. 4, the plate 20 and the arm 42 may assume different geometric proportions depending on the specific design. The embodiment shown in FIG. 4 is just one of many embodiments within the spirit and scope of the present invention.

Referring back to FIG. 2, the arm 42 is in a down position with the table 14 disposed underneath the seat 18. In FIG. 3, the arm 42 is in the up position with the table 14 disposed upward in a horizontal plane. Returning to FIG. 4, the arm 42 is locked in the up position shown in FIG. 3 via the engagement between the pin 48 and the aperture 50 disposed in the plate 20. The pin 48 passes through the collar 52 and is spring-biased toward the plate 20 by the spring 54 and passes through the hole 56 in the arm 42. When the arm 42 has reached the up position, the aperture 50 and the pin 48 are in alignment and the spring forces the pin inward to matably engage the aperture 50. This action locks the arm in the up position illustrated in FIGS. 3, 4, 7 and 8.

Figure 7:
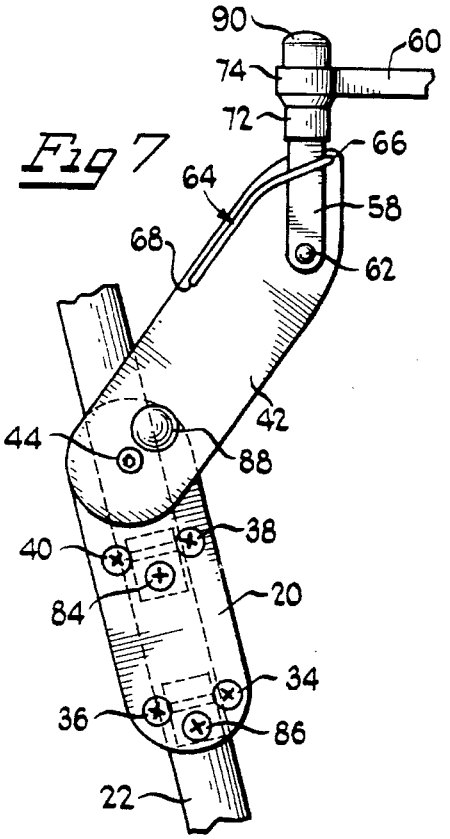
FIG. 7 is a right side view of the means for attaching the table attachment of the present invention to a chair, particularly illustrating the arm in an up position.
Figure 8:
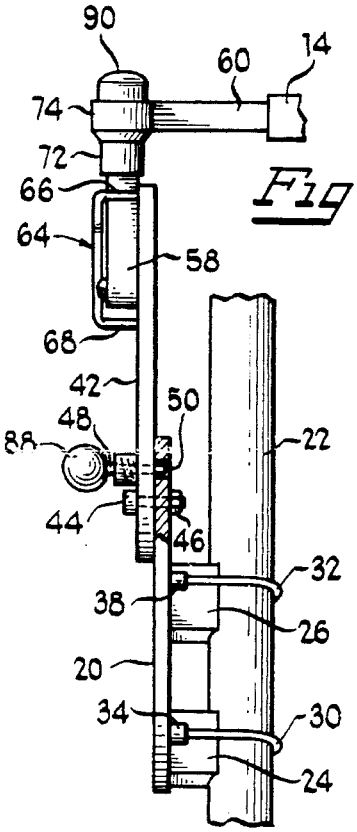
FIG. 8 is a front plan view of the means for attachment shown in FIG. 7.

Still referring to FIG. 4, the table may be pivotally attached directly to the arm 42, or as shown in FIG. 4, a link 58 may be pivotally attached to the arm 42 which, in turn, is pivotally attached to the frame 60 which supports the table 14. The link 58 may be attached to the arm 42 with a bolt or pin such as the one shown at 62. The brace 64 restricts the pivotal movement of the link 58. The top leg 66 of the brace engages the link 58 when the table 14 is in the up position as illustrated in FIGS. 3, 7 and 8 and the lower leg 68 restricts the pivotal downward movement of the link 58. The link 58 may include a shaft 70 disposed at the upper end of the link 58 for pivotally engaging the frame 60. As seen in FIG. 4, the shaft 70 matably engages a bushing 72 which, in turn, engages the collar 74 disposed at the end of the frame 60. The frame 60, collar 74 and bushing 72 pivot about the shaft 70 to provide pivotal movement of the table 14 about the shaft 70 and link 58. The hex nut or dog shown at 76 is accommodated in the slot in the bushing shown at 78. The engagement of the dog 76 with the wall 80 of the slot 78 limits the inward pivotal movement of the table 14 towards the user and engagement of the dog 76 with the wall 82 of the slot 78 limits the outward pivotal movement of the table 14 away from the user.

Figure 5:
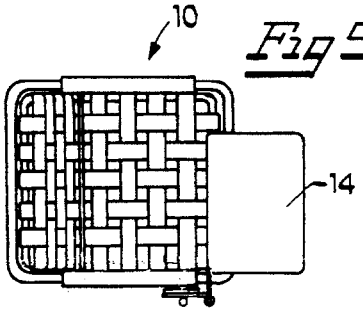
FIG. 5 is a top plan view of the chair shown in FIG. 3, particularly illustrating the table attachment as it would be used by a person eating a meal.
Figure 6:
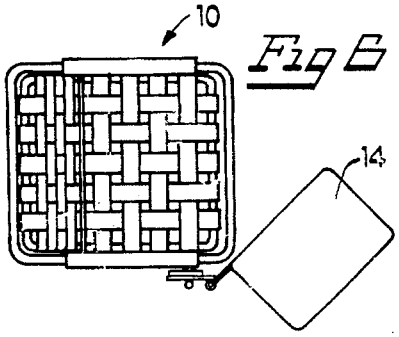
FIG. 6 is another top plan view of e hair shown in FIG. 3, particularly illustrating the table attachment pivoted outward thereby enabling the user to get out of the chair or sit down in the chair.

Turning to FIGS. 5 and 6, the horizontal pivotal movement of the table 14 is illustrated. In FIG. 5, the table 14 is pivoted forward toward the user and the dog 76 is engaging the wall 80 of the slot 78 of the bushing 72. In FIG. 6, the table 14 has been pivoted away from the user and the dog 76 is engaging the wall 82 of the slot 78 of the bushing 72.

Turning to FIG. 7, the arm 42 is in the upright position. The plate 20 is secured to the leg 22 with the four nuts 34, 36, 38, 40 which engage the U-shaped brackets 30, 32 (see FIG. 4). Further the plate 20 is secured to the blocks 24, 26 with the screws 84, 86. The link 58 engages the upper leg 66 of the brace 64 due to the force of gravity imposed by the table 14 (not shown in FIG. 7) and frame 60. The arm 42 is locked into the up position via the engagement of the pin 48 and the aperture 50 disposed in the plate 20 (see FIGS. 4 and 8).

Turning to FIG. 8, the arm 42 is disposed upward and the pin 48 is now accommodated in the aperture 50 disposed in the plate 20. A ball handle 88 may be attached to the outer end of the pin 48 to make it easier to remove the pin 48 from the aperture 50 when it is desired to lower the table 14 to the down position.

FIG. 8 also illustrates the advantages of the specific means for attaching the table attachment 12 to the leg 22. Specifically, the U-shaped brackets 30, 32 are relatively thin and will not interfere or otherwise catch on a user's leg that may rub on the inside surface of the chair leg 22. Further, the annular nuts 34, 36, 38, 40 (only 34, 38 are shown in FIG. 8) are flush with the outer surface of the plate 20 so as to not interfere with the upward and downward pivotal movement of the arm 42. As seen in FIG. 8, the plate 20 has a smooth profile despite the four nuts 34, 36, 38, 40 and two screws 84, 86 (see also FIGS. 4 and 7) used to attach the plate 20 to the chair leg 22. In addition, as noted above, an additional block similar to the ones shown at 24, 26 may be used to secure the upper end of the plate 20 against the leg 22. In FIGS. 7 and 8, an ornamental cap 90 covers the slot 78 and dog 76.

Figure 9:
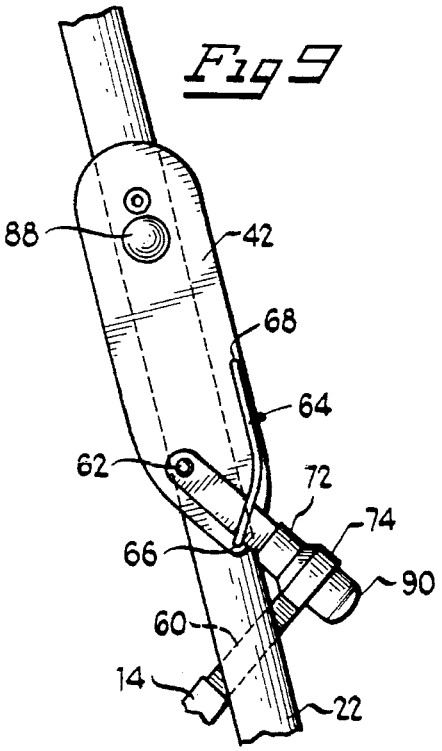
FIG. 9 is yet another illustration of the means for attachment shown in FIG. 7, particularly illustrating the arm in a down position and the table folded underneath the seat.

FIG. 9 is an enlarged side view of the arm 42 in the down position as illustrated in FIG. 2. The ball handle 88 has been pulled out and the pin 48 (not shown) is no longer engaging the aperture 50 disposed in the plate 20 (not shown) and the force of gravity returns the arm 42 to the down position shown in FIG. 9. The frame 60 and table 14 are disposed behind the chair leg 22 and the table 14 is disposed underneath the seat 18 as first shown in FIG. 2.

Figure 10:
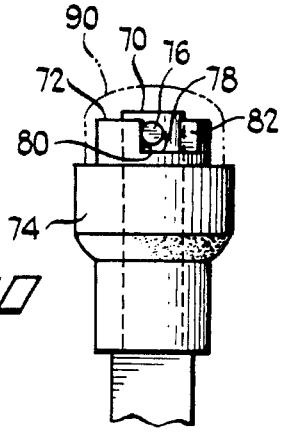
FIG. 10 is an enlarged view of the means for pivotally connecting the table to the arm or link.
Figure 11:
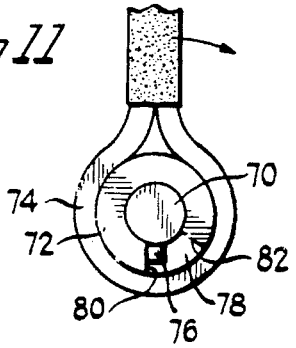
FIG. 11 is a top view of the means for pivotally connecting the table to the arm or link shown in FIG. 10.

FIGS. 10 and 11 illustrate the restriction on the pivotal movement of the table 14 in the horizontal plane imposed by the dog 76 and slot 78. In FIG. 10, the dog 76 is engaging the wall 80 and the table 14 has been pivoted fully inward toward the user. It will be remembered that the shaft 70 and dog 76 do not rotate, the bushing 72 and collar 74 rotate. When the table 14 has pivoted outward, the wall 82 swings around and engages the dog 76. The collar 74 and bushing 72 are further illustrated in FIG. 11. Of course, the specific shaft 70, bushing 72, collar 74 arrangement shown is not required but is just one preferred embodiment. For example, a shaft-like protrusion may be mounted directly on or be an integral part of the upper end of the arm 42 and the table may be pivotally mounted thereto by a variety of means similar to those illustrated in FIGS. 10 and 11.

Thus, one preferred embodiment of the present invention has been illustrated in FIGS. 1 through 11. Various means for mounting the table attachment 12 are apparent. The specific means for mounting the table attachment 12 to the chair 10 and the specific means for providing the necessary pivotal movement of the table 14 may be varied substantially without departing from the spirit and scope of the present invention.

The table attachment 12 may be provided as the original equipment with a chair 10 or may be provided in the form of a retrofit kit. The tabletops 14 may also be easily removed and replaced with clean tabletops 14 and further may be simply disposable. A variety of materials may be used for each component illustrated. As noted above, the plate 20 and arm 42 may be made from aluminum or other metals. The link 58, bushing 72, collar 74 and frame 60 are preferably made from steel but aluminum or other metals may be used. Further, suitable plastics and other materials may be used to fabricate the structural components of the table attachment 12.

Although only one preferred embodiment of the present invention has been illustrated and described, it will at once be apparent to those skilled in the art that variations may be made within the spirit and scope of the present invention. Accordingly, it is intended that the scope of the present invention be limited solely by the scope of the hereafter appended claims and not by any specific wording in the foregoing description.

I claim:

1. A table attachment for mounting onto a leg of a chair, the chair also having a seat with a space disposed underneath the seat, the table attachment comprising:

a plate for mounting directly onto the leg of the chair;

an arm pivotally attached to the plate, the arm capable of pivotal movement in a generally vertical plane from a down position to an up position;

means for locking the arm in a fixed position against the plate and in the up position;

a frame;

means for pivotally connecting said frame to the arm;

the frame capable of pivotal movement in a generally horizontal plane when the arm is in the up position;

a table supported by the frame, the table being disposable in the space underneath the seat of the chair when the arm is in the down position.

2. The table attachment of claim 1, wherein the means for pivotally connecting a frame to the arm includes a link connected to the arm, the link being pivotally connected to the frame.

3. The table attachment of claim 2, wherein the link is pivotally attached to the arm and is capable of pivotal movement in a generally vertical plane.

4. The table attachment of claim 3, wherein the arm further includes a first stop to restrict upward pivotal movement of the link and a second stop to restrict downward pivotal movement of the link.

5. The table attachment of claim 4, wherein the link includes a shaft extending outward from a distal end thereof, the frame includes a collar, the shaft is accommodated in the collar to pivotally attach the frame to the link.

6. The table attachment of claim 5, wherein the shaft includes means for restricting pivotal movement of the collar and frame about the shaft.

7. The table attachment of claim 5, wherein the collar further includes a bushing disposed within the collar, the bushing includes a slot, the shaft includes a dog, the dog being accommodated in the slot, the dog limiting pivotal movement of the slot and thereby restricting pivotal movement of the bushing, the collar and the frame about the shaft.

8. The table attachment of claim 7, wherein the means for locking the arm in the up position includes a pin passing through the arm and being spring-biased toward the plate, the plate includes an aperture for accommodating the pin when the arm is in the up position.

9. The table attachment of claim 8, wherein the chair is further characterized as having a back, a pair of front legs, and a pair of rear legs, the chair being capable of assuming a folded position where the back adjoins the seat and the rear legs adjoin the front legs, the table adjoining an underside of the seat when the chair is in the folded position.

10. A table attachment for a chair, the attachment comprising:

mounting means for connecting the table attachment directly to a leg of the chair;

a link means;

arm means pivotally connected to said mounting means, said arm means for pivotally connecting said link means to the mounting means and providing vertical pivotal movement of the table attachment;

the link means connecting the arm means to a frame means;

the frame means for pivotally connecting the link means to a table top and providing horizontal pivotal movement of the table top;

the table top supported by the frame means.

11. The attachment of claim 10, wherein the link means is pivotally connected to the arm means and also provides vertical pivotal movement of the frame means and table top.

12. The attachment of claim 11, further comprising stop means to restrict pivotal movement of the link means.

13. The attachment of claim 12, wherein the arm means further includes a means for locking the arm means in an upright position with respect to the mounting means.

14. The attachment of claim 13, wherein the means for locking the arm means in the upright position includes a pin that passes through the arm means and matably engages an aperture disposed in the mounting means, the pin and aperture being in alignment when the arm means is in the upright position.

15. The attachment of claim 14, further comprising stop means to restrict pivotal movement of the frame means.

16. A table attachment for mounting onto a leg of a chair, the chair also having a seat with a space disposed underneath the seat, the table attachment comprising:

a plate for mounting onto the leg of the chair;

an arm pivotally attached to the plate, the arm capable of pivotal movement in a generally vertical plane from a down position to an up position;

means for locking the arm in the up position;

a frame;

means for pivotally connecting said frame to the arm, said means for pivotally connecting said frame to the arm including a link pivotally connected to the arm, the link being capable of pivotal movement in a generally vertical plane, the arm further including a first stop to restrict upward pivotal movement of the link and a second stop to restrict downward pivotal movement of the link, the link including a shaft extending outward from a distal end thereof, the frame including a collar, the shaft of the link being accommodated in the collar to pivotally attach the frame to the link, the frame capable of pivotal movement in a generally horizontal plane when the arm is in the up position;

a table supported by the frame, the table being disposed in the space underneath the seat of the chair when the arm is in the down position.

17. The table attachment of claim 16, wherein the shaft includes means for restricting pivotal movement of the collar and frame about the shaft.

18. The table attachment of claim 16, wherein the collar further includes a bushing disposed within the collar, the bushing includes a slot, the shaft includes a dog, the dog being accommodated in the slot, the dog limiting pivotal movement of the slot and thereby restricting pivotal movement of the bushing, the collar and the frame about the shaft.

19. The table attachment of claim 16, wherein the means for locking the arm in the up position includes a pin passing through the arm and being spring-biased toward the plate, the plate includes an aperture for accommodating the pin when the arm is in the up position.

20. The table attachment of claim 16, wherein the chair is further characterized as having a back, a pair of front legs, and a pair of rear legs, the chair being capable of assuming a folded position where the back adjoins the seat and the rear legs adjoin the front legs, the table adjoining an underside of the seat when the chair is in the folded position.

21. A table attachment for a chair, the attachment comprising:

mounting means for connecting the table attachment to a leg of the chair;

arm means for pivotally connecting a link means to the mounting means and providing vertical pivotal movement of the table attachment, the arm means further includes a means for locking the arm means in an upright position with respect to the mounting means, the means for locking the arm means in the upright position includes a pin that passes through the arm means and matably engages an aperture disposed in the mounting means, the pin and aperture being in alignment when the arm means is in the upright position;

the link means connecting the arm means to a frame means, the link means is pivotally connected to the arm means and also provides vertical pivotal movement of the frame means;

the frame means for pivotally connecting the link means to a table top and providing horizontal pivotal movement of the table top, the table top supported by the frame means;

stop means to restrict pivotal movement of the link means.

22. The attachment of claim 21, further comprising stop means to restrict pivotal movement of the frame means.

* * * * *